US005410576A

United States Patent [19]

Perrotti

[11] Patent Number: 5,410,576

[45] Date of Patent: Apr. 25, 1995

[54] CONTAINERS FOR DISPOSING OF LOW LEVEL RADIOACTIVE WASTE AND ITS DETECTION

[76] Inventor: Donald J. Perrotti, 7 Bessemer St., Greenville, Pa. 16125

[21] Appl. No.: 179,134

[22] Filed: Jan. 10, 1994

[51] Int. Cl.[6] ..... G21F 5/00

[52] U.S. Cl. ..... 376/272; 250/506.1; 220/404; 206/305

[58] Field of Search ..... 376/272; 250/506.1, 250/507.1; 252/633; 220/504, 404; 206/305, 306

[56] References Cited

U.S. PATENT DOCUMENTS 4,907,717 3/1990 Kubofeik ..... 250/506.1
5,059,797 10/1991 Bukowski ..... 250/506.1
5,265,755 11/1993 McArthur, Jr. et al. ..... 220/404

*Primary Examiner*—Daniel D. Wasil

[57] ABSTRACT

A container for disposing of low level radioactive waste and its detection comprises a container having a cylindrical side wall of an enlarged diameter and an enlarged height. The container has a bottom wall with its exterior periphery coupled to the lower edge of the side wall. The container also has an aperture through the center of the bottom wall with an upwardly extending cylindrical support of a reduced diameter and shortened height extending upwardly from the aperture of the bottom wall. A liner is formed of a flexible material. The liner is configured to fit interiorly of the side wall with its upper edges extending over the upper edge thereof. The liner has a lower face adapted to be positioned on the interior face of the bottom wall. The liner also has an upwardly extending cylindrical extension adapted to be positioned over the upwardly extending interior cylinder of the container.

5 Claims, 3 Drawing Sheets

CONTAINERS FOR DISPOSING OF LOW LEVEL RADIOACTIVE WASTE AND ITS DETECTION

BACKGROUND OF THE INVENTION

1. Field of the Invention

The present invention relates to containers for disposing of low level radioactive waste and its detection and more particularly pertains to disposing of low level radioactive waste through specially configured containers adapted to detect its presence therewithin.

2. Description of the Prior Art

The use of containers is known in the prior art. More specifically, containers heretofore devised and utilized for the purpose of supporting waste to be disposed are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 244,393 to Collica discloses a waste container for radioactive material.

U.S. Pat. No. 4,495,139 to Janberg discloses a radioactive waste container with leak monitor.

U.S. Pat. No. 4,760,268 to Noe discloses a container for low or medium activity radioactive waste.

U.S. Pat. No. 4,894,550 to Baatz discloses a shielded radioactive waste container.

Lastly, U.S. Pat. No. 4,996,019 to Catalayoud discloses a storage container for radioactive waste.

In this respect, the containers for disposing of low level radioactive waste and its detection according to the present invention substantially depart from the conventional concepts and designs of the prior art, and in doing so provide an apparatus primarily developed for the purpose of disposing of low level radioactive waste through specially configured containers adapted to detect its presence therewithin.

Therefore, it can be appreciated that there exists a continuing need for new and improved containers for disposing of low level radioactive waste and its detection which can be used for disposing of low level radioactive waste through specially configured containers adapted to detect its presence therewithin. In this regard, the present invention substantially fulfills this need.

SUMMARY OF THE INVENTION

In view of the foregoing disadvantages inherent in the known types of containers now present in the prior art, the present invention provides improved containers for disposing of low level radioactive waste and its detection. As such, the general purpose of the present invention, which will be described subsequently in greater detail, is to provide a new and improved container for disposing of low level radioactive waste and its detection and method which has all the advantages of the prior art and none of the disadvantages.

To attain this, the present invention essentially comprises a new and improved container for disposing of low level radioactive waste and its detection comprising a container having a cylindrical side wall of an enlarged diameter and an enlarged height. The container has a bottom wall with its exterior periphery coupled to the lower edge of the side wall. The container also has a recess through the center of the base plate with an upwardly extending cylindrical support of a reduced diameter and shortened height extending upwardly from the aperture of the base plate. A liner is formed of a flexible material. The liner is configured to fit interiorly of the side wall with its upper edges extending over the upper edge thereof. The liner has a lower face adapted to be positioned on the interior face of the base plate. The liner also has an upwardly extending cylindrical extension adapted to be positioned over the upwardly extending interior cylinder of the container. A holder having a base, side walls and a cut-out in the exterior wall positioned on the exterior surface of the side wall adjacent the lower extent thereof for holding a meter. The meter is of the type having a probe for radioactive material positionable upwardly through the aperture of the base plate into the interior cylinder. A lid is provided in a circular configuration with a downwardly extending flange positionable over the exterior periphery of the container at its upper edge.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved containers for disposing of low level radioactive waste and its detection which have all the advantages of the prior art containers and none of the disadvantages.

It is another object of the present invention to provide new and improved containers for disposing of low level radioactive waste and its detection which may be easily and efficiently manufactured and marketed.

It is further object of the present invention to provide new and improved containers for disposing of low level radioactive waste and its detection which are of durable and reliable constructions.

An even further object of the present invention is to provide new and improved containers for disposing of low level radioactive waste and its detection which are susceptible of a low cost of manufacture with regard to both materials and labor, and which accordingly are then susceptible of low prices of sale to the consuming public, thereby making such containers for disposing of low level radioactive waste and its detection economically available to the buying public.

Still yet another object of the present invention is to provide new and improved containers for disposing of low level radioactive waste and its detection which provide in the apparatuses and methods of the prior art some of the advantages thereof, while simultaneously overcoming some of the disadvantages normally associated therewith.

Still another object of the present invention is to dispose of low level radioactive waste through specially configured containers adapted to detect its presence therewithin.

Lastly, it is an object of the present invention to provide new and improved containers for disposing of low level radioactive waste and its detection comprising a container having a cylindrical side wall of an enlarged diameter and an enlarged height. The container has a bottom wall with its exterior periphery coupled to the lower edge of the side wall. The container also has an aperture through the center of the bottom wall with an upwardly extending cylindrical support of a reduced diameter and shortened height extending upwardly from the aperture of the bottom wall. A liner is formed of a flexible material. The liner is configured to fit interiorly of the side wall with its upper edges extends over the upper edge thereof. The liner has a lower face adapted to be positioned on the interior face of the bottom wall. The liner also has an upwardly extending cylindrical extension adapted to be positioned over the upwardly extending interior cylinder of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
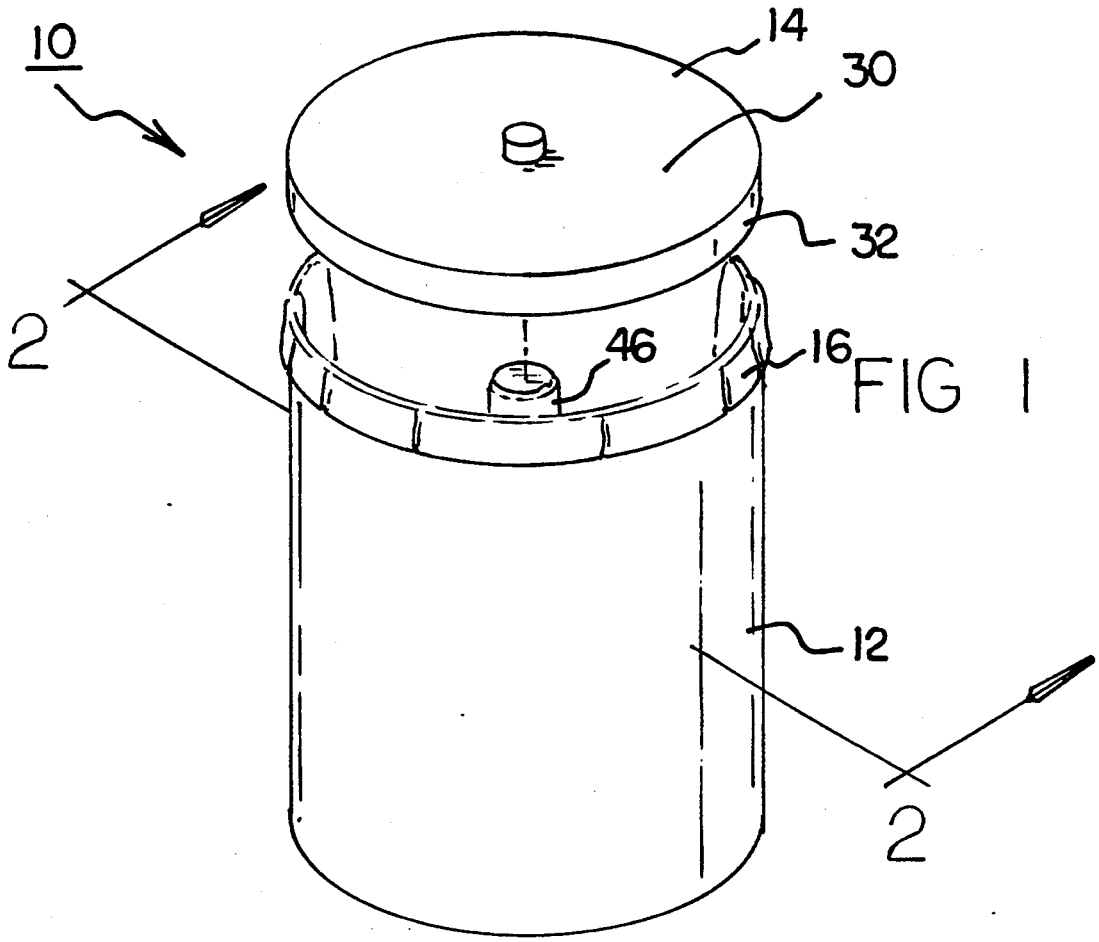
FIG. 1 is a perspective illustration of the preferred embodiment of the containers for disposing of low level radioactive waste and its detection constructed in accordance with the principles of the present invention.

With reference now to the drawings, and in particular to FIG. 1 thereof, the preferred embodiment of the new and improved containers for disposing of low level radioactive waste and its detection embodying the principles and concepts of the present invention and generally designated by the reference numeral 10 will be described.

Specifically, the container for disposing low level radio active waste, in its preferred embodiment is simply constructed of three major components, such components are the container 12, the lid 14 and the liner 16. These components function together for their intended purposes.

More specifically, the first component of the container system is the container 12. The container has a cylindrical side wall 20 of an enlarged diameter and an enlarged height. The container also has a bottom wall 22. Its exterior periphery is circular and coupled to the lower edge of the side wall 20. Also formed as part of the container is a recess 24. The recess is located in the center of the bottom wall 22. It has an upwardly extending cylindrical support 26 with a closed top. Such cylindrical support is of a reduced diameter and shortened height so as to extend upwardly from the aperture of the bottom wall to an elevation neneath the upper edge of the side wall.

The second component of the container system is the lid 14. The lid is simply a circular plate 30. It has downwardly extending flanges 32 around its periphery. The flanges are sized to be positioned over the exterior periphery of the container 12 around its upper edge and to have located therebetween the ridge of a liner secured to the container as will be described.

The container 12 and liner 14 are preferably each molded of a one piece construction, suitable molding material include any rigid or semi-rigid elastomer such as polyurethane, polyethalene, polypropalene or silicone rubber.

Figure 2:
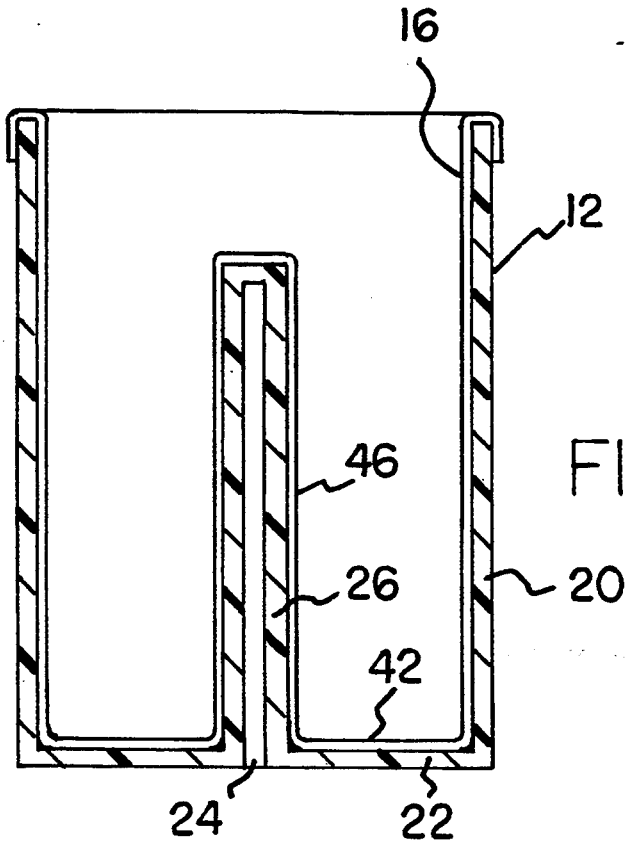
FIG. 2 is a cross-sectional view taken along line 2–2 of FIG. 1.
Figure 3:
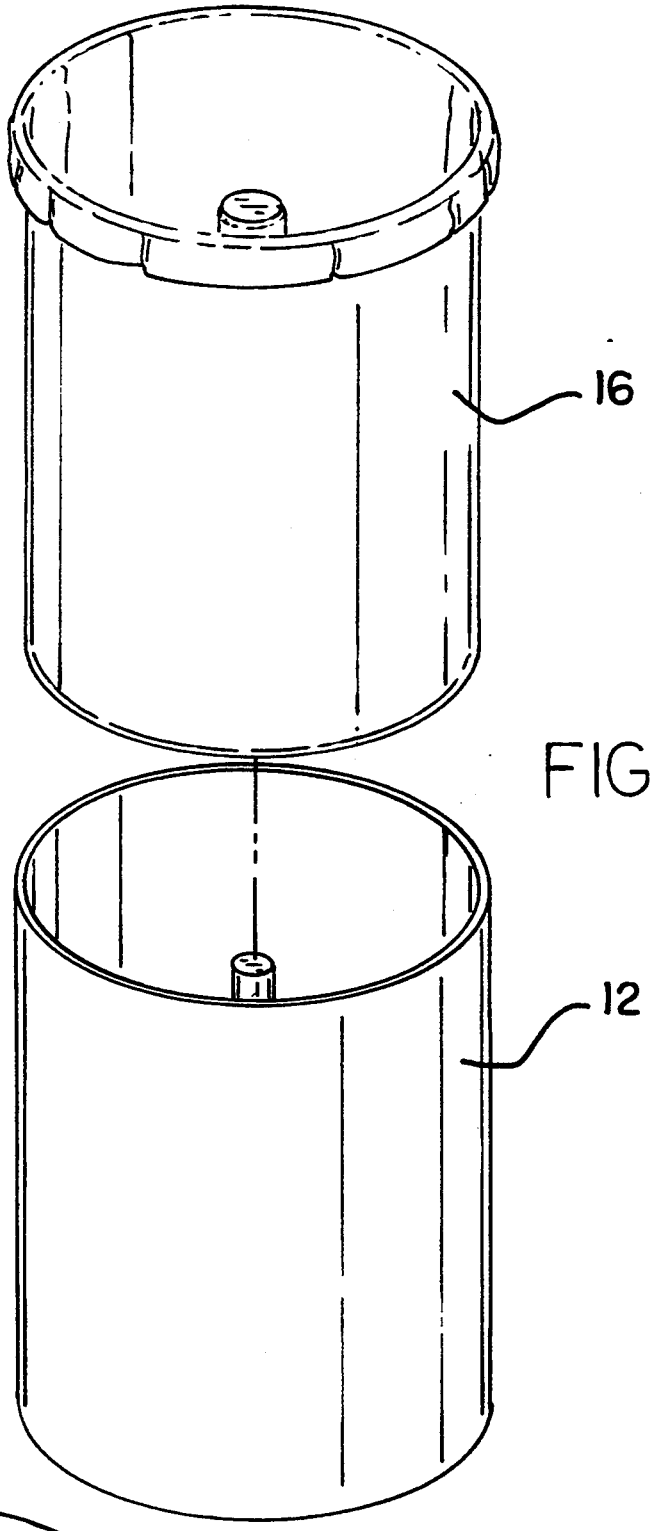
FIG. 3 is an exploded view of the container and liner bag of FIGS. 1 and 2.
Figure 4:
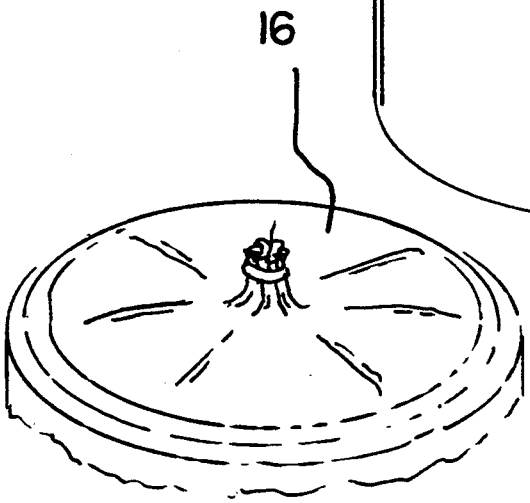
FIG. 4 is a perspective illustration of the liner of the prior Figures when tied for disposing of its contents.

The last component of the system is the liner 16. The liner 16 is fabricated from a sheet of flexible material. It is preferably of a one piece construction. The liner is configured to fit interiorly of the side wall 20 of the container 12 with its upper edges extending over the over edge of the container. Note FIGS. 1, 2 and 3. The liner also is formed with a lower face 42. The lower face is adapted to be positioned on the interior or upper face of the bottom wall. The liner is also formed to have in its central extend an upwardly extending cylindrical extension 46 with a closed top. Such extension is adapted to be positioned over the upwardly extending interior cylinder of the container. The liner when positioned within the container as shown in FIG. 2 and when covered by the lid 14 thus provides a chamber for the receipt of material which may or may not have a low level of radio active waste therein.

Figure 5:
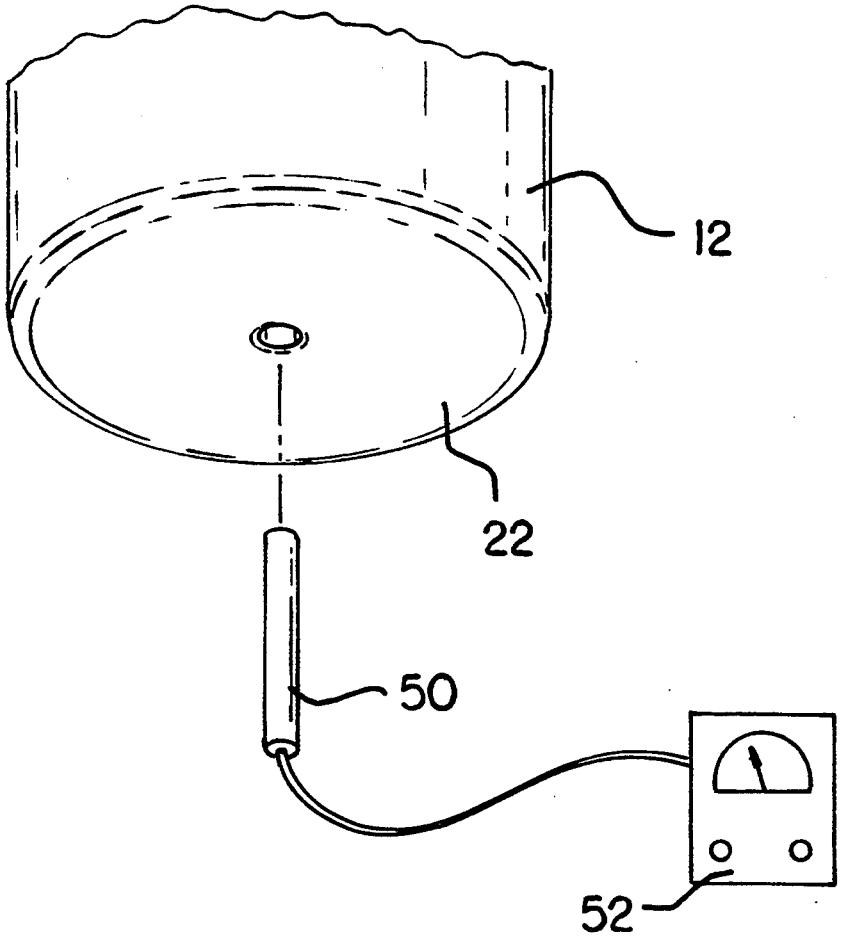
FIG. 5 is a perspective illustration of the lower portion of the container of the prior Figures illustrating a meter being inserted therein.

The interior of the upwardly extending cylindrical support 16 is adapted to receive a probe 50 of a dosemeter 52 as of a conventional type. With the probe located centrally of the container and waste, it is readily adapted to detect any radio active waste contained therein, even of a low level. Note FIG. 5.

Figure 6:
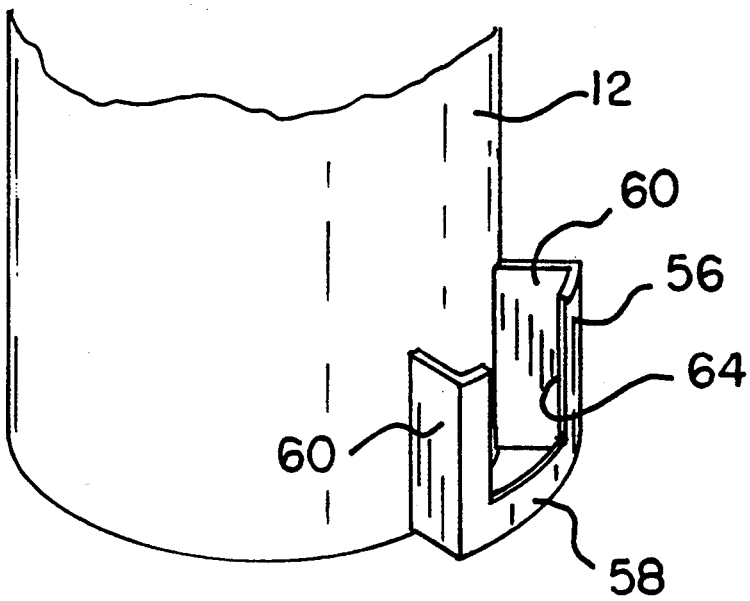
FIG. 6 is illustrates an alternate embodiment of the invention which includes a holder for the meter of FIG. 5.

An alternate embodiment of the invention is shown in FIG. 6. In such embodiment, a holder 56 is secured to the exterior surface of the container at its lower extent. The holder has a lower support face 58, side faces 60 and a front face 62 with a U-shaped cut-out 64. The size and shape of the holder 56 is such as to hold the dosemeter 52 in proper position with respect to the container during operation and use. The cut-out 64 allows viewing the dial of the dosemeter when supported in holder 56.

One of the biggest problems with disposing of low level radioactive waste is that the self-shielding quality of the solid waste makes it difficult to detect the low levels of radio active contamination that may be present. The style of the bags currently used to store this type of waste also contribute to this difficulty. The present invention is a new style storage container designed to eliminate this problem.

The present invention consists of a rigid plastic container and a plastic liner. The present invention holds about 20 to 25 gallons of waste, is 5 to 7 millimeters thick and has a plastic tube molded into the bottom of the container that is large enough to allow a low level radiation detector to be inserted into it. The bag is made with a long cylindrical inset shaped to fit over the tube in the container. This design ensures that there will be a shaft in the center of the bag even after it is filled and removed from the container. After the bag is filled, it can be checked for low level radioactive contamination by inserting a radioactive detector, protected by this design, into the shaft. If the waste is found to be contaminated, the entire bag can then be disposed of properly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved container for disposing of low level radioactive waste and its detection comprising, in combination:

a container having a cylindrical side wall of an enlarged diameter and an enlarged height, the container having a base plate with its exterior periphery coupled to the lower edge of the side wall, the container also having an aperture through the center of the base plate with an upwardly extending cylindrical support of a reduced diameter and shortened height extending upwardly from the aperture of the base plate;

a liner formed of a flexible material, the liner being configured to fit interiorly of the side wall with its upper edges extending over the upper edge thereof, the liner having a lower face adapted to be positioned on the interior face of the base plate, the liner also having an upwardly extending cylindrical extension adapted to be positioned over the upwardly extending interior cylinder of the container;

a holder having a base, side wall and a cut-out in the exterior wall of the holder, and being positioned on the exterior surface of the cylindrical side wall of the container adjacent the lower extent thereof for holding a meter, the meter being of the type having a probe for radioactive material positionable upwardly through the aperture of the base plate into the interior cylinder; and a lid in a circular configuration with a downwardly extending flange positionable over the exterior periphery of the container at its upper edge.

2. A container for disposing of low level radioactive waste and its detection comprising:

a container having a cylindrical side wall of an enlarged diameter and an enlarged height, the container having a bottom wall with its exterior periphery coupled to the lower edge of the side wall, the container also having an aperture through the center of the bottom wall with an upwardly extending cylindrical support of a reduced diameter and shortened height extending upwardly from the aperture of the bottom wall; and a liner formed of a flexible material, the liner being configured to fit interiorly of the side wall with its upper edges extending over the upper edge thereof, the liner having a lower face adapted to be positioned on the interior face of the bottom wall, the liner also having an upwardly extending cylindrical extension adapted to be positioned over the upwardly extending interior cylinder of the container.

3. The container as set forth in claim 2 and further including:

a lid in a circular configuration with a downwardly extending flange positionable over the exterior periphery of the container at its upper edge.

4. The container as set forth in claim 2 and further including:

a holder having a base, side wall on the exterior surface of the cylindrical side wall of the container adjacent the lower extent thereof for holding a meter, the meter being of the type having a probe for radioactive material positionable upwardly through the aperture of the base plate into the interior cylinder.

5. The container as set forth in claim 4 and further including:

a cut-out in the exterior side wall of the holder for viewing the meter when supported in the holder.

* * * * *